US006681525B1

(12) United States Patent
Dudley

(10) Patent No.: US 6,681,525 B1
(45) Date of Patent: Jan. 27, 2004

(54) HANDICAPPED TRAIN-STATION GATE

(76) Inventor: David Edmond Dudley, 2673 Million Ct., San Jose, CA (US) 95148

( * ) Notice: Subject to any disclaimer, the term of this patent is extended or adjusted under 35 U.S.C. 154(b) by 147 days.

(21) Appl. No.: 09/714,004

(22) Filed: Nov. 15, 2000

(51) Int. Cl.[7] ..... E05F 11/00; E05F 3/04

(52) U.S. Cl. ..... 49/358; 49/326; 49/381; 16/62

(58) Field of Search ..... 49/55, 57, 50, 49/359, 463, 465, 358, 326, 381; 52/202, 203; 16/49, 51, 62, 66, 69, 64, DIG. 9, DIG. 10; 256/73, 24–26

(56) References Cited

U.S. PATENT DOCUMENTS

| | | | | | |
|---|---|---|---|---|---|
| 1,668 | A | * | 7/1840 | Barton, Jr. | |
| 1,121,084 | A | * | 12/1914 | Finken | |
| 1,126,635 | A | * | 1/1915 | Henry | |
| 1,627,113 | A | * | 5/1927 | Pearson | |
| 1,759,474 | A | * | 5/1930 | Volquardsen | |
| 3,135,991 | A | * | 6/1964 | Ellis | |
| 3,156,001 | A | * | 11/1964 | Schmid | |
| 3,373,529 | A | * | 3/1968 | Ingham | |
| 3,852,846 | A | * | 12/1974 | Slaybaugh | 16/48.5 |
| 4,429,264 | A | * | 1/1984 | Richmond | 318/466 |
| 4,686,739 | A | * | 8/1987 | Fritsche et al. | 16/79 |
| 4,872,239 | A | * | 10/1989 | Ferguson et al. | 16/64 |
| 5,651,216 | A | * | 7/1997 | Tillmann | 49/367 |
| 5,706,551 | A | | 1/1998 | Jeynes et al. | 16/59 |
| 5,732,508 | A | * | 3/1998 | Latta et al. | 49/386 |
| 5,749,122 | A | | 5/1998 | Herbst | 16/70 |
| 5,868,382 | A | * | 2/1999 | Groves | 49/55 X |
| 6,176,044 | B1 | * | 1/2001 | Nixon et al. | 49/506 |

* cited by examiner

*Primary Examiner*—Hugh B. Thompson
(74) *Attorney, Agent, or Firm*—Richard B. Main

(57) ABSTRACT

A handicapped-entrance gate for retrofitting a train-station comprises a door panel that forces itself normally closed, but can be pushed open from either side. A closing mechanism is fully contained within a cap rail along to top edge of the door and operates in either direction to close the gate slowly after it has been opened. Fixed axles enter the gate panel from above and below on the pivoting side. The closing mechanism is geared to at least one of these fixed axles to allow the gate to be opened easily and to self-close over a period of time. Springs are used in opposition to hydraulic dampers such that the springs close the gate and the dampers delay the closing.

2 Claims, 2 Drawing Sheets

HANDICAPPED TRAIN-STATION GATE

BACKGROUND OF THE INVENTION

1. Field of the Invention

The present invention relates to gates and barriers, and more particularly to retrofitting train-station platforms with two-way operable gates for handicapped people in wheelchairs that cannot pass through the regular turnstiles.

2. Description of Related Art

Some modern train and rail stations use automated ticketing and turnstiles. For example, the San Francisco Bay Area Rapid Transit (BART) sells magnetic-coded paper tickets out of wall-mounted machines and the passengers use the tickets in a separate turnstile. The tickets are inserted into the entering and exiting turnstiles at the start and end of the trip, and computers automatically deduct the correct fare and open the air-operated gate.

Such turnstile openings are very narrow and impossible for handicapped people to negotiate. So the BART stations were originally fitted with spring-loaded fence gates, but these only swung-open in one direction. The gates proved very hard to open if one was in a wheelchair on the "wrong" side of the gate.

Unfortunately, the handicapped fence-gates originally installed by BART had their operating mechanisms completely buried in the floor. And many of the floors were poured-concrete. This makes adjusting the mechanisms and certainly replacing them a very expensive, labor-intensive job.

Jackson Corporation (Los Angeles, Calif.) has a line of commercial door control products that include overhead concealed closers, surface mounted closers, floor closers, and pivots. Conventional door closers are not concealed within the door panel itself, but rather in the floor below or the door jamb above. For example, a prior art door closer is described by Peter Brown in U.S. Pat. No. 5,291,630, issued Mar. 8, 1994. The only placement suggested for it is to embed it in the floor.

SUMMARY OF THE INVENTION

An object of the present invention is to provide a two-way opening fence gate.

Another object of the present invention is to provide a fence gate that can be operated by people restricted to wheelchairs.

A further object of the present invention is to provide a gate opening device that can be retrofitted to gates with buried-in-the-floor mechanisms.

Briefly, a gate embodiment of the present invention comprises a door panel that forces itself normally closed, but can be pushed open from either side. A closing mechanism is fully contained within a cap rail along to top edge of the door and operates in either direction to close the gate slowly after it has been opened. Fixed axles enter the gate panel from above and below on the pivoting side. The closing mechanism is geared to at least one of these fixed axles to allow the gate to be opened easily and to self-close over a period of time. Springs are used in opposition to hydraulic dampers such that the springs close the gate and the dampers delay the closing.

An advantage of the present invention is a gate is provided that can be pushed open from either side.

Another advantage of the present invention is that a gate is provided that can be safely and conveniently operated by people in wheelchairs.

A still further advantage of the present invention is that a gate opening device is provided that can be used to retrofit other types at reduced cost.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
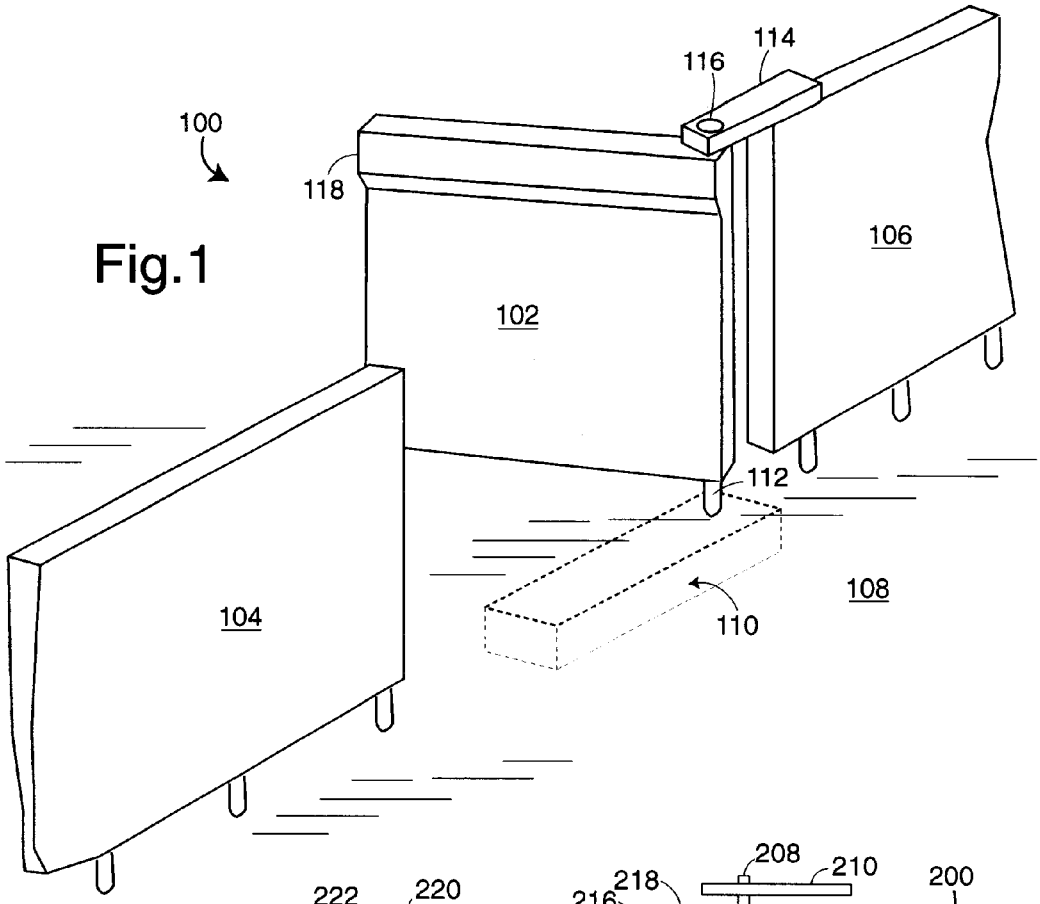
FIG. 1 is a perspective-view diagram of a gate and fence system embodiment of the present invention.

FIG. 1 represents a fence and gate system embodiment of the present invention, and is referred to herein by the general reference numeral 100. The fence and gate system 100 comprises a swinging gate 102 that spans between the opening in a pair of fence panels 104 and 106 on a floor 108. An abandoned door closer 110 may be present from an earlier installation. Such door closers 110 are conventionally concealed in the floor 108 and are hard to adjust, repair, and/or replace. A typical door closer allows the door to swing only to one side of the fence. Here, the gate 102 can be pushed either way to both sides of the fence to allow two-way traffic to pass through. Once the gate 102 is released, it closes itself slowly enough not to catch a person passing through, but surely enough to guarantee closure if the opening is not blocked.

Instead, embodiments of the present invention critically include a door closer inside the gate itself. A bottom pivot 112 carries the weight of the gate. A bracket 114 supports a fixed axle 116 that passes down into the gate. A cap rail 118 contains a closing mechanism that works back and forth against the axle 116 to keep the gate closed.

Figure 2:
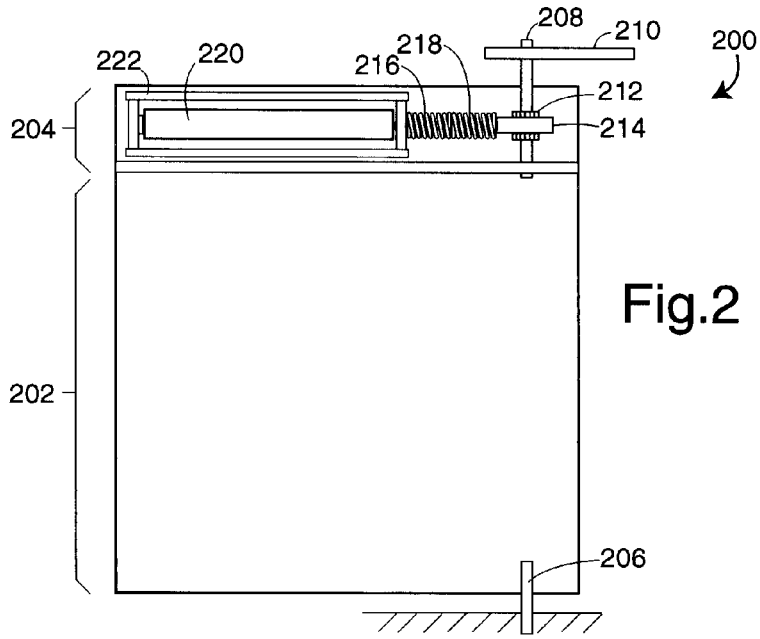
FIG. 2 is a side-view of a gate embodiment of the present invention that can be used in the fence and gate system of FIG. 1.

FIG. 2 illustrates a gate embodiment of the present invention, and is referred to herein by the general reference numeral 200. Such gate is typically two or three feet tall and used in a train station to control passengers and fares. A preferred use of the gate 102 is to allow handicapped passengers in wheelchairs to push themselves through.

A relatively thin panel 202 is topped by a thicker cap rail 204. A bottom pivot 206 is fixed within the floor and supports the weight of the gate on a swivel. A top axle 208 is fixed to a fence bracket 210. A pinion gear 212 fastened to the top axle 208 engages a pair of rack gears 214. (Only the rack gear on the near side is visible in FIG. 2.) The rack gear 214 is connected by a shaft that passes through a set of compression springs 216 and 218 to a hydraulic piston 220. A similar assembly of springs and pistons is on the other side. A frame 222 supports the pistons 220, and also the springs 216 and 218. As the gate 200 is swung in-and-out, the pinion gear 212 forces the rack gears 214 to move in opposite directions. One side or the other will compress the springs 216 and 218. Such spring compression will force the gate back closed when the gate is no longer being pushed open. How fast the gate can close is regulated by the piston 220, which is very similar to an automobile shock absorber. However here, the piston 220 is valved to collapse easily and quickly, but resist being re-expanded by the spring.

Figure 3A:
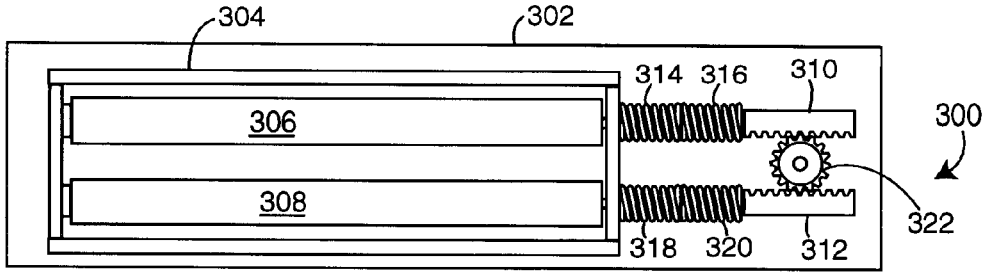
FIGS. 3A–3C are top-view diagrams of a gate closer embodiment of the present invention that can be used in the gate of FIG. 2.
Figure 3B:
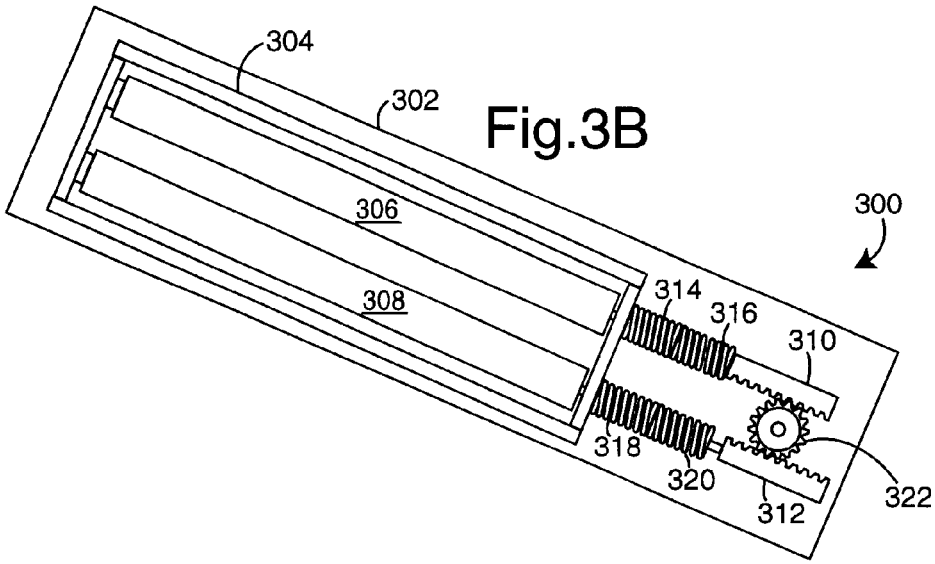
Figure 3C:
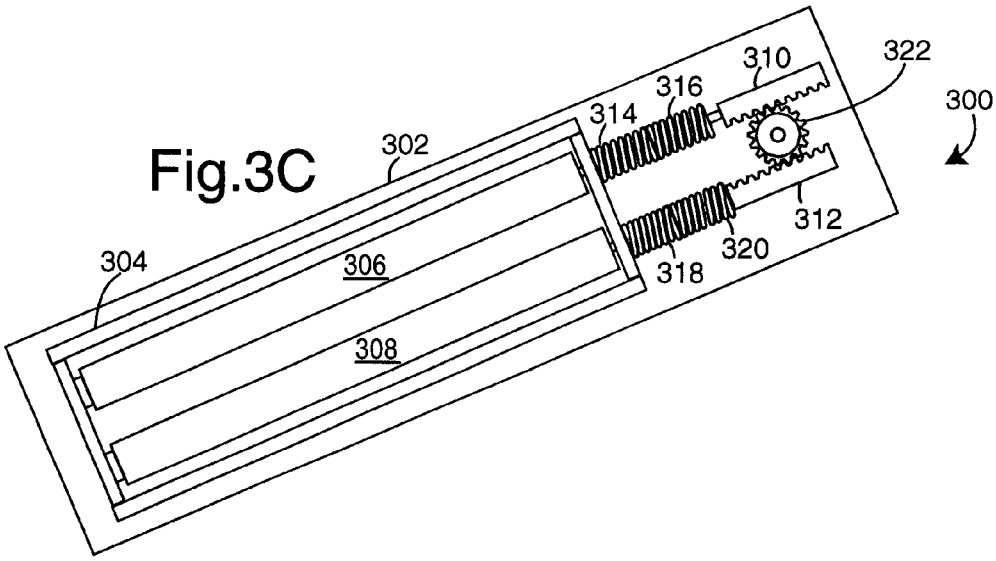

FIGS. 3A–3C show a top view of a gate 300 in three different positions, closed (FIG. 3A), swung out (up in FIG. 3B), and swung in (down in FIG. 3C). A cap rail housing 302 in the gate encloses all the door closing mechanism needed.

A frame 304 encloses and braces a pair of hydraulic dampers 306 and 308. These are respectively connected to a pair of opposite rack gears 310 and 312 that can slide in parallel to one another. A set of compression springs 314 and 316 are quite stiff and can exert a hundred pounds of force between the rack gear 310 and the frame 304. Similarly, a set of compression springs 318 and 320 and can exert an equal force between the rack gear 312 and the frame 304. As shown in FIG. 3A, such springs are about fully expanded when in the neutral, closed-gate position. An adjustment is preferably included to balance the forces so the gate will assume a fully closed position on its own.

A pinion gear 322 is fixed to a stationary axle that does not turn as the gate is opened or closed. Pushing the gate open causes the rack gears 310 and 312 to be moved in opposite directions within the plane of the gate. The springs then react to re-establish the equilibrium.

In FIG. 3B, springs 314 and 316 are compressed by the movement of the rack gear 310 toward the frame 304. Once released, hydraulic damper 306 will slow down but not stop the springs 314 and 316 from working through the rack gear 310 and pinion gear 322 to close the gate.

In FIG. 3C, springs 318 and 320 are compressed by the movement of the rack gear 312 toward the frame 304. This time when the gate is released, hydraulic damper 308 will slow down but not stop springs 318 and 320 from working through the rack gear 312 and pinion gear 322 to close the gate from the other side.

A gate retrofit installation method embodiment of the present invention comprises removing a one-way swinging gate from a fence opening. A pre-existing closer mechanism concealed in the floor is left in place to avoid the expense and time involved in removing it. A gate like that illustrated in FIGS. 1, 2, and 3A–3C is installed in the opening. A bracket is used to connect the top of the gate to one side of the fence opening at the top. Such gate includes a closer mechanism fully enclosed in a cap rail area inside the top portion of the gate. The mechanism allows the gate to be pushed open to either side, and includes a damper to delay an automatic mechanical re-closing.

In general, embodiments of the present invention fully enclose the door-closer mechanisms used by them within the volume of the door or gate panel. It is critical that no surface mounted units or units concealed in the floor or door jambs be used to control the door closing. Such surface mounted units are subject to catching people passing through low gates, and the units concealed in the floor or door jambs are difficult to adjust, repair and replace.

In some installations of embodiments of the present invention, it is preferable to use commercially marketed components and assemblies as much as is practical. In one embodiment of the present invention, a concealed overhead door closer manufactured by Jackson Corporation (Los Angeles, Calif.) was embedded within a gate, as in FIG. 1, rather than in the overhead door jamb. Of course in the installation shown in FIG. 1, there is no overhead door jamb, so the installation intended by the manufacturer is not possible. The prior art door closer described by Peter Brown in U.S. Pat. No. 5,291,630, could also be used inside the gate of FIG. 1 in accordance with this disclosure.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A gate and fence system, comprising:

a floor-mounted fence with an opening;

an upper and a lower pivot axle placed at one side of said opening;

a swinging gate disposed in said opening and pivotally supported on the upper and lower pivot axles, and able to be pushed open from both sides of the fence;

a thin panel with no front or back surface openings, and which is disposed across the full width of the swinging gate, and for preventing the catching of people passing through said opening;

a cap rail that tops the thin panel and spans across said full width, and that is thicker front-to-back than the thin panel;

a gate closer disposed inside the cap rail and which provides for a delayed re-closing of the swinging gate after being opened;

a hydraulic damper disposed in the gate closer and mechanically providing for said delayed re-closing of the swinging gate after being opened;

a compression spring disposed in the gate closer and mechanically providing for a re-closing of the gate after being opened;

a rack gear connected to the hydraulic damper and able to act on the compression spring when the swinging gate is opened; and a pinion gear engaged with the rack gear and fixed to the upper pivot axle such that a decompression of the spring provides for a twisting action that can close the swinging gate.

2. A gate and fence system, comprising:

a floor-mounted fence with an opening;

an upper and a lower Divot axle placed at one side of said opening;

a swinging gate disposed in said opening and pivotally supported on the upper and lower pivot axles, and able to be pushed open from both sides of the fence;

a thin panel with no front or back surface openings, and which is disposed across the full width of the swinging gate, and for preventing the catching of people passing through said opening;

a cap rail that tops the thin panel and spans across said full width, and that is thicker front-to-back than the thin panel;

a gate closer disposed inside the cap rail and which provides for a delayed re-closing of the swinging gate after being opened;

a pair of oppositely acting hydraulic dampers disposed in the gate closer and mechanically providing for said delayed re-closing of the swinging gate after being opened in either direction;

a set of springs disposed in the gate closer and mechanically providing for a re-closing of the swinging gate after being opened;

a pair of oppositely acting rack gears respectively connected to each of the hydraulic dampers and able to act on the set of springs when the swinging gate is opened; and a pinion gear engaged with each of the pair of oppositely acting rack gears, and which is fixed to the upper pivot axle such that a relaxation of the set of springs provides for an appropriately directed gate-closing twisting action.

* * * * *